US005391290A

United States Patent [19]

Ichiba et al.

[11] Patent Number: 5,391,290

[45] Date of Patent: Feb. 21, 1995

[54] METHOD FOR CONTINUOUSLY TIN-ELECTROPLATING METAL STRIP

[75] Inventors: Mikiyuki Ichiba; Hiroki Iwasa; Toyofumi Watanabe; Masaaki Yamashita; Katsumi Kojima, all of Tokyo, Japan

[73] Assignee: NKK Corporation, Tokyo, Japan

[21] Appl. No.: 38,529

[22] Filed: Mar. 29, 1993

[30] Foreign Application Priority Data

Apr. 21, 1992 [JP] Japan ..... 4-128201
Sep. 16, 1992 [JP] Japan ..... 4-272335
Oct. 13, 1992 [JP] Japan ..... 4-299133

[51] Int. Cl.[6] ..... C25D 5/20

[52] U.S. Cl. ..... 205/140; 205/148; 205/303

[58] Field of Search ..... 205/140, 148, 154, 303

[56] References Cited

U.S. PATENT DOCUMENTS 5,174,887 12/1992 Federman et al. ..... 205/253

FOREIGN PATENT DOCUMENTS 58-45395 3/1983 Japan .
63-118094 5/1988 Japan .

OTHER PUBLICATIONS

W. D. Mogerman, Ultrasonics in the Plating Industry, *Plating*, Aug. 1967, pp. 941–947.

A. Roll, The Influence of Sound and Ultrasound on Electro-Chemical Processes, The Engineers' Digest, Aug. 1952, vol. 13 No. 8 pp. 257–259; Sep. 1952, vol. 13 No. 8, pp. 314–316; Oct. 1952, vol. 13, No. 10, pp. 357–360.

H. E. Ricks, Ultrasonics improves, shortens and simplifies plating operations, MPJM, Mar. 1962, pp. 17–19.

Chemical Abtracts, vol. 103, No. 18, Nov. 1985, Columbus, Ohio, US; Abstract No. 149619m, Ratajewics "Electroplating With Tin Alloys", p. 518; of PL-A-127 385, Feb. 28, 1985.

Chemical Abstracts, vol. 105, No. 10, Sep. 1986, Columbus, Ohio, US; Abstract No. 87475s, Samel "Electrodeposition of Tin From Sulfamate Solution", p. 572; of Trans. Inst. Met. Finish., vol. 64, No. 3, 1986, (Eng)., pp. 119–123.

C. T. Walker et al, "Effets de l'agitation ultrasonique sur certaines proprietes des depots galvaniques", Nov. 1974, Galvano-Organo, No. 449, pp. 1009–1014.

*Primary Examiner*—John Niebling
*Assistant Examiner*—William T. Leader
*Attorney, Agent, or Firm*—Frishauf, Holtz, Goodman & Woodward

[57] ABSTRACT

A method for continuously tin-electroplating a metal strip, which comprises the steps of: causing a DC electric current to flow between a metal strip and an anode arranged adjacent to the metal strip while passing the metal strip at a travelling speed of at least 1 m/minute through an acidic tin-electroplating solution containing tin ions and an organic acid within a range of from 4.8 to 98 g/l as converted into sulfuric acid, to form a tin-electroplating layer on at least one surface of the metal strip; and applying an ultrasonic vibration, emitted from at least one ultrasonic vibrator and having an intensity within a range of from 0.01 to 1,000 W/100 $cm^2$ and a frequency within a range of from 25 to 55 kHz, to the acidic tin-electroplating solution between the metal strip and the anode, thereby removing a diffusion layer of tin ions existing in the acidic tin-electroplating solution adjacent to the surface of the metal strip.

4 Claims, 7 Drawing Sheets

METHOD FOR CONTINUOUSLY TIN-ELECTROPLATING METAL STRIP

As far as we know, there are available the following prior art documents pertinent to the present invention:

(1) The periodical "Galvano-Organo-Traitements de Surface", Vol. 43, No. 449, November 1974, pages 1,009–1,014;

(2) Japanese Patent Provisional Publication No. 63-118,094 published on May 23, 1988; and (3) Japanese Patent Provisional Publication No. 58-45,395 published on Mar. 16, 1983.

The contents of the prior arts disclosed in the above-mentioned prior art documents will be discussed hereafter under the heading of the "BACKGROUND OF THE INVENTION."

BACKGROUND OF THE INVENTION

1. Field of the Invention

The present invention relates to a method for continuously tin-electroplating a metal strip.

2. Related Art Statement

As a method for continuously tin-electroplating a metal strip, there is known a method using an acidic tin-electroplating solution containing tin ions and an organic acid, which comprises the steps of: causing a DC electric current to flow between a metal strip and an anode arranged adjacent to said metal strip while passing said metal strip at a prescribed travelling speed through an acidic tin-electroplating solution containing tin ions and an organic acid, to form a tin-electroplating layer on at least one surface of said metal strip.

When divalent tin ions are present alone without combining with the other ions in an acidic tin-electroplating solution not containing an organic acid, the divalent tin ions are oxidized into tin oxides, during the tin-electroplating, by means of oxygen contained in the acidic tin-electroplating solution, causing the production of sludge in a considerable quantity. The thus produced sludge adheres onto the tin-electroplating layer formed on the surface of the metal strip, resulting in a lower quality of the tin-electroplating layer.

In contrast, when an acidic tin-electroplating solution containing an organic acid is used, divalent tin ions are combined with the organic acid during the tin-electroplating to form a complex, thereby inhibiting the production of sludge caused by the oxidation of divalent tin ions to avoid the above-mentioned inconvenience.

However, the above-mentioned method using the acidic tin-electroplating solution containing the tin ions and the organic acid has the following problems:

Formation of the tin-electroplating layer on the surface of the metal strip during the tin-electroplating comprises the following three steps: a movement step in which divalent tin ions in the acidic tin-electroplating solution move toward the surface of the metal strip (hereinafter referred to as the "material transfer process"); an electric charge transfer step on the surface of the metal strip (hereinafter referred to as the "electric charge transfer process"); and a crystallization step of tin on the surface of the metal strip (hereinafter referred to as the "crystallization process").

The divalent tin ions in the form of the complex are low in the transfer rate in the acidic tin-electroplating solution. Furthermore, the divalent tin ions in the form of the complex are dissociated into independent divalent tin ions upon the precipitation onto the surface of the metal strip. During the tin-electroplating, therefore, there is a portion of the acidic tin-electroplating solution, in which the divalent tin ion concentration becomes gradually lower from a position a prescribed distance apart from the surface of the metal strip toward the surface of the metal strip (such a portion being hereinafter referred to as the "diffusion layer of tin ions"). In the tin-electroplating using an acidic tin-electroplating solution containing tin ions and an organic acid, therefore, the material transfer process acts as a rate-determining step because of the presence of the diffusion layer of tin ions during the tin-electroplating, thus limiting the progress rate of all the other processes.

When carrying out the tin-electroplating with a high electric current density in a state in which the material transfer process acts as the rate-determining layer, i.e., in a state in which there is present the diffusion layer of tin-ions, the quality of the tin-electroplating layer formed on the surface of the metal strip is deteriorated as described below:

(1) Tin particles having precipitated onto the surface of the metal strip grow into a dendritic shape, leading to a grayish color of the tin-electroplating layer formed on the surface of the metal strip, i.e., a poorer external appearance.

(2) Adhesion of the tin-electroplating layer formed on the surface of the metal strip to the metal strip becomes lower.

(3) Even when a melting treatment, i.e., a reflowing treatment is applied to the tin-electroplated metal strip after the completion of the tin-electroplating, a desired gloss cannot be imparted to the tin-electroplating layer.

In order to prevent deterioration of the quality of the tin-electroplating layer as described above, it is necessary to decrease the electric current density per supply of electricity, and this results in a lower critical electric current density. A lower critical electric current density in turn leads to a smaller tin-plating weight per supply of electricity, and to more frequent supply of electricity in order to ensure a desired tin-plating weight. Since electricity is supplied only once for each tin-electroplating tank, more frequent supply of electricity requires more tin-electroplating tanks, and hence resulting in increased manufacturing and equipment costs.

As a means to solve the problems regarding the decrease in the critical electric current density caused by the presence of the diffusion layer of divalent tin ions, there is known a technology of providing an ejecting mechanism for ejecting an acidic tin-electroplating solution into the acidic tin-electroplating solution between the metal strip and the anode, and causing the acidic tin-electroplating solution between the metal strip and the anode to flow by means of the ejecting mechanism.

When conducting the tin-electroplating at such a high electric current density as over 100 A/dm$^2$, however, it is necessary to eject the acidic tin-electroplating solution at a high rate of over about 5 to 10 m/second into the acidic tin-electroplating solution between the metal strip and the anode. This requires a large-scale and expensive ejecting mechanism. It is furthermore very difficult to control the ejecting rate of the tin-electroplating solution.

As means to solve the problems regarding the decrease in the critical electric current density caused by the presence of the diffusion layer of metal ions, many techniques using an ultrasonic vibration have been reported since the 1940s. T. Walker et al., for example, released their report as described below in the periodical "Galvano-Organo-Traitements de Surface", vol. 43, No. 449, November 1974, pages 1,009–1,014:

(1) By applying an ultrasonic vibration to an electroplating solution between a metal strip and an anode to remove a diffusion layer of metal ions existing in the electroplating solution adjacent to the surface of the metal strip, some improvement is expected in the increase in the critical electric current density, as well as in hardness, internal stress and gloss of a metal-electroplating layer precipitated onto the surface of the metal strip.

(2) However, since the effect of the ultrasonic vibration on the tin-electroplating largely depends upon the electroplating solution, the electroplating conditions and the structure of the electroplating equipment, it is difficult to quantitatively show the effect of the ultrasonic vibration.

In order to solve the problems regarding the decrease in the critical electric current density caused by the presence of the diffusion layer of metal ions, the following horizontal-type electroplating apparatus using an ultrasonic vibration has been proposed:

A horizontal-type electroplating apparatus disclosed in Japanese Patent Provisional Publication No. 63-118,094 published on May 23, 1988, which comprises: a horizontal-type electroplating tank in which an electroplating solution is forcedly circulated; two anode plates each arranged above and below a metal strip at a prescribed distance therefrom and in parallel to said metal strip, which metal strip travels horizontally through said electroplating solution in said electroplating tank, each of said anode plates having a plurality of through-holes becoming gradual narrower toward said metal strip; and a plurality of ultrasonic vibrators each arranged outside said anode plate relative to said metal strip at a prescribed distance from said anode plate, for each of said through-holes (hereinafter referred to as the "prior art 1").

Accordingly to the above-mentioned prior art 1, the diffusion layer of metal ions existing in the electroplating solution adjacent to the surface of the metal strip can be removed by applying an ultrasonic vibration, having a frequency within a range of from 10 to 1,000 kHz and emitted form the ultrasonic vibrators toward the metal strip, through the through-holes to the electroplating solution between the metal strip and the anode plate.

However, the prior art 1 contains neither concrete disclosure nor suggestion regarding a means to solve the problems involved in the method for tin-electroplating using an acidic tin-electroplating solution containing tin ions and an organic acid.

For the purpose of solving the problems regarding the decrease in the critical electric current density caused by the presence of the diffusion layer of metal ions, the following method for electroplating using an ultrasonic vibration has been proposed:

A method for electroplating disclosed in Japanese Patent Provisional Publication No. 58-45,345 published on Mar. 16, 1983, which comprises the steps of: providing a nozzle adjacent to an end of an anode provided below a main roll; emitting an ultrasonic wave from said nozzle during the electroplating to apply an ultrasonic vibration to an electroplating solution between a travelling metal strip and said anode; and at the same time, ejecting an electroplating solution containing bubbles from said nozzle into the electroplating solution between said metal strip and said anode to cause the electroplating solution between said metal strip and said anode to flow (hereinafter referred to as the "prior art 2").

According to the above-mentioned prior art 2, it is possible to remove the diffusion layer of metal ions existing in the electroplating solution adjacent to the surface of the metal strip.

However, the prior art 2 contains neither concrete disclosure nor suggestion regarding a means to solve the problems involved in the method for tin-electroplating using an acidic tin-electroplating solution containing tin ions and an organic acid.

Under such circumstances, there is a strong demand for the development of a method for continuously tin-electroplating a metal strip, which, when causing a DC electric current to flow between a metal strip and an anode arranged adjacent to the metal strip while passing the metal strip through an acidic tin-electroplating solution containing tin ions and an organic acid, to form a tin-electroplating layer on at least one surface of the metal strip, enables to increase the critical electric current density by removing a diffusion layer of tin ions existing in the acidic tin-electroplating solution adjacent to the surface of the metal strip, so as to form a tin-electroplating layer excellent in quality on the surface of the metal strip at a high electric current density, and furthermore, to reduce the number of tin-electroplating tanks by reducing the frequency of supply of electricity, thereby permitting reduction of costs for manufacture and equipment, but such a method has not as yet been proposed.

SUMMARY OF THE INVENTION

An object of the present invention is therefore to provide a method for continuously tin-electroplating a metal strip, which, when causing a DC electric current to flow between a metal strip and an anode arranged adjacent to the metal strip while passing the metal strip through an acidic tin-electroplating solution containing tin ions and an organic acid, to form a tin-electroplating layer on at least one surface of the metal strip, enables to increase the critical electric current density by removing a diffusion layer of tin ions existing in the acidic tin-electroplating solution adjacent to the surface of the metal strip, so as to form a tin-electroplating layer excellent in quality on the surface of the metal strip at a high electric current density, and furthermore, to reduce the number of tin-electroplating tanks by reducing the frequency of supply of electricity, thereby permitting reduction of costs for manufacture and equipment.

In accordance with one of the features of the present invention, there is provided a method for continuously tin-electroplating a metal strip, which comprises the steps of:

causing a DC electric current to flow between a metal strip and an anode arranged adjacent to said metal strip while passing said metal strip at a travelling speed of at least 1 m/minute through an acidic tin-electroplating solution containing tin ions and an organic acid within a range of from 4.8 to 98 g/l as converted into sulfuric acid, to form a tin-electroplating layer on at least one surface of said metal strip; and applying an ultrasonic vibration, emitted from at least one ultrasonic vibrator and having an intensity within a range of from 0.01 to 1,000 W/100 $cm^2$ and a frequency within a range of from 25 to 55 kHz, to said acidic tin-electroplating solution between said metal strip and said anode, thereby removing a diffusion layer of tin ions existing in said acidic tin-electroplating solution adjacent to the surface of said metal strip.

In the above-mentioned method of the present invention for continuously tin-electroplating a metal strip, the acidic tin-electroplating solution containing the tin ions and the organic acid may additionally contain a phenyl hydroxide compound within a range of from 0.1 to 5 g/l.

The above-mentioned organic acid comprises at least one of benzene sulfonic acid, methane sulfonic acid, toluene sulfonic acid and phenol sulfonic acid.

The above-mentioned phenyl hydroxide compound comprises at least one of pyrocatechol, resorcinol, hydrochinone, phloroglucinol, pyrogallol and 3-aminophenol.

In the above-mentioned method of the present invention for continuously tin-electroplating the metal strip, an acidic tin-electroplating solution may be ejected into the acidic tin-electroplating solution between the metal strip and the anode to cause the acidic tin-electroplating solution between the metal strip and the anode to flow.

DETAILED DESCRIPTION OF PREFERRED EMBODIMENTS

Figure 1:
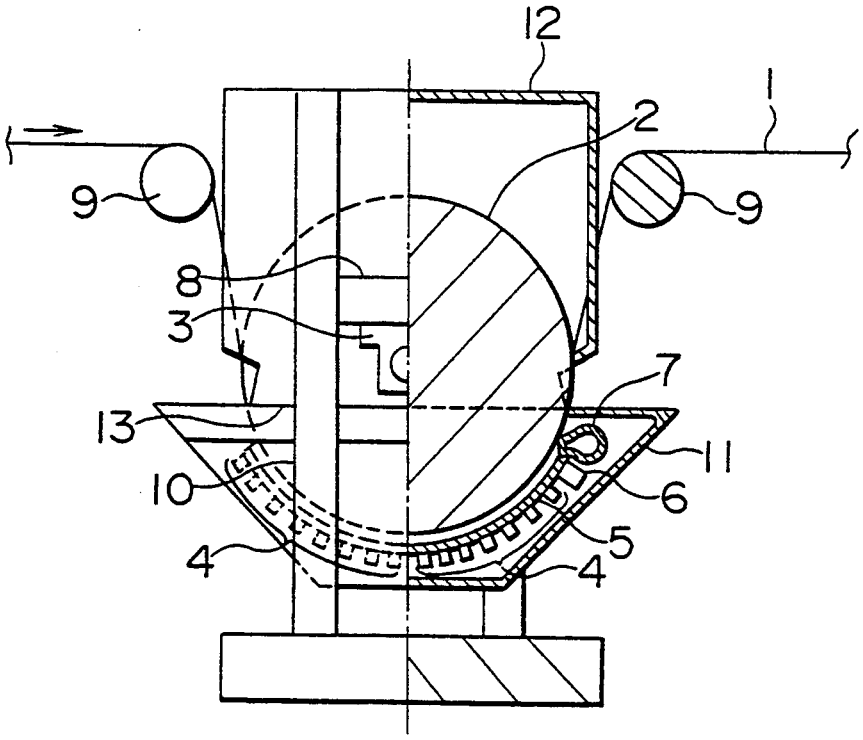
FIG. 1 is a partially cutaway schematic side view illustrating an embodiment of the method of the present invention using the conventional radial-type tin-electroplating apparatus.

The following experiments (1) and (2) were carried out to develop a method for continuously tin-electroplating a metal strip, which, when causing a DC electric current to flow between a metal strip and an anode arranged adjacent to the metal strip while passing the metal strip through an acidic tin-electroplating solution containing tin ions and an organic acid, to form a tin-electroplating layer on at least one surface of the metal strip, enables to increase the critical electric current density by removing a diffusion layer of tin ions existing in the acidic tin-electroplating solution adjacent to the surface of the metal strip, so as to form a tin-electroplating layer excellent in quality on the surface of the metal strip at a high electric current density, and furthermore, to reduce the number of tin-electroplating tanks by reducing the frequency of supply of electricity, thereby permitting reduction of costs for manufacture and equipment:

(1) An acidic tin-electroplating solution containing tin ions and an organic acid was completely deaerated with the use of argon gas. Then, an ultrasonic vibration having an intensity within a range of from 0.01 to 1,000 w/100 $cm^2$ and a frequency within a range of from 1 to 1,500 kHz was applied to the acidic tin-electroplating solution for a prescribed period of time. Then the acidic tin-electroplating solution was aerated in the open air for a prescribed period of time. Subsequently, the amount of produced sludge in the acidic tin-electroplating solution was investigated upon the lapse of the above-mentioned prescribed priod of time.

For comparison purposes, an acidic tin-electroplating solution containing tin ions and an organic acid was aerated in the open air for a prescribed period of time without conducting the above-mentioned deaeration with argon gas and without the above-mentioned application of ultrasonic vibration. Then, the amount of produced sludge in the acidic tin-electroplating solution was investigated upon the lapse of the above-mentioned prescribed period of time.

Comparison of the acidic tin-electroplating solution with and without the application of the ultrasonic vibration, demonstrated that the case with the application of the ultrasonic vibration resulted in a larger quantity of produced sludge than in the case without the application of the ultrasonic vibration. With an ultrasonic frequency within a range of from 25 to 55 kHz, the amount of produced sludge was particularly large. A large amount of produced sludge implies that the amount of oxidized divalent tin ions, which are the cause of the production of sludge, is large and the dissociation of divalent tin ions from the complex is accelerated.

(2) When causing a DC electric current to flow between the metal strip and the anode while passing the metal strip through the acidic tin-electroplating solution containing the tin ions and the organic acid, to form a tin-electroplating layer on at least one surface of the metal strip, an ultrasonic vibration having a frequency within a range of from 1 to 1,500 kHz was applied to the acidic tin-electroplating solution between the metal strip and the anode. As a result, there was observed an increase in the critical electric current density with an ultrasonic frequency within a range of from 1 to 1,000 kHz. Particularly with an ultrasonic frequency within a range of from 25 to 55 kHz, the critical electric current density increased considerably.

From the results of the experiments (1) and (2) described above, the following findings were obtained:

By applying an ultrasonic vibration having a frequency within a range of from 25 to 55 kHz to an acidic tin-electroplating solution containing tin ions and an organic acid, the acidic tin-electroplating solution is stirred, thus accelerating the dissociation of divalent tin ions from the complex and removing the diffusion layer of divalent tin ions, and the critical electric current density increases.

The present invention was made on the basis of the above-mentioned findings. The method of the present invention is described below in detail.

The method of the present invention for continuously tin-electroplating a metal strip comprises the steps of: causing a DC electric current to flow between a metal strip and an anode arranged adjacent to said metal strip while passing said metal strip at a travelling speed of at least 1 m/minute through an acidic tin-electroplating solution containing tin ions and an organic acid within a range of from 4.8 to 98 g/l as converted into sulfuric acid, to form a tin-electroplating layer on at least one surface of said metal strip; and applying an ultrasonic vibration, emitted from at least one ultrasonic vibrator and having an intensity within a range of from 0.01 to 1,000 W/100 $cm^2$ and a frequency within a range of from 25 to 55 kHz, to said acidic tin-electroplating solution between said metal strip and said anode, thereby removing a diffusion layer of tin ions existing in said acidic tin-electroplating solution adjacent to the surface of said metal strip.

In the above-mentioned method of the present invention for continuously tin-electroplating a metal strip, an acidic tin-electroplating solution may be ejected into the acid tin-electroplating solution between the metal strip and the anode to cause the acidic tin-electroplating solution between the metal strip and the anode to flow.

By applying an ultrasonic vibration, emitted from at least one ultrasonic vibrator and having an intensity within a range of from 0.01 to 1,000 W/100 $cm^2$ and a frequency within a range of from 25 to 55 khz, to the acidic tin-electroplating solution between the metal strip and the anode, the dissociation of divalent tin ions from the complex is accelerated, and the diffusion layer of tin ions existing in the acidic tin-electroplating solution adjacent to the surface of the metal strip is removed. In addition, bubbles present in the acidic tin-electroplating solution between the metal strip and the anode are finely pulverized.

The ultrasonic intensity should be limited within a range of from 0.01 to 1,000 W/100 $cm^2$. With an ultrasonic intensity of under 0.01 W/100 $cm^2$, no cavitation occurs in the acidic tin-electroplating solution, and this makes it impossible to stir the acidic tin-electroplating solution. With an ultrasonic intensity of over 1,000 W/100 $cm^2$, on the other hand, temperature of the acidic tin-electroplating solution becomes higher as a result of the absorption of the ultrasonic waves.

The ultrasonic frequency should be limited within a range of from 25 to 55 kHz. By limiting the ultrasonic frequency within a range of from 25 to 55 kHz, the dissociation of divalent tin ions from the complex is accelerated, and the diffusion layer of divalent tin ions existing in the acidic tin-electroplating solution adjacent to the surface of the metal strip is removed, thus considerably increasing the critical electric current density. With an ultrasonic frequency of under 25 kHz or over 55 kHz, the dissociation of divalent tin ions from the complex is not accelerated. A desired effect is unavailable in the removal of the diffusion layer of divalent tin ions, and it is impossible to increase the critical electric current density.

The methods for applying the ultrasonic vibration to the acidic tin-electroplating solution between the metal strip and the anode are as follows, provided however that, so far as the ultrasonic vibration can be applied to the acidic tin-electroplating solution between the metal strip and the anode, the manner of application of the ultrasonic vibration is not limited to the following methods:

(1) attaching at least one ultrasonic vibrator to the anode, and vibrating the anode by means of the ultrasonic vibration emitted from the ultrasonic vibrator, thereby applying the ultrasonic vibration to the acidic tin-electroplating solution between the metal strip and the anode;

(2) attaching at least one ultrasonic vibrator to the inner surface of the tin-electroplating tank, and applying the ultrasonic vibration emitted from the ultrasonic vibrator to the acidic tin-electroplating solution between the metal strip and anode; and (3) attaching at least one ultrasonic vibrator to the inner surfaces of the rolls in contact with the metal strip including the conductor roll, and vibrating the roll by means of the ultrasonic vibration emitted from the ultrasonic vibrator to vibrate the metal strip, thereby applying the ultrasonic vibration to the acidic tin-electroplating solution between the metal strip and the anode.

The travelling speed of the metal strip should be at least 1 m/minute. With a travelling speed of the metal strip of under 1 m/minute, the stirring effect of the acidic tin-electroplating solution by the travel of the metal strip is unavailable. Tin ions cannot therefore be continuously supplied onto the surface of the metal strip, adhesion of the tin-electroplating layer to the metal strip thus becomes defective, and the electrolytic efficiency is degraded.

The content of the organic acid in the acidic tin-electroplating solution should be limited within a range of from 4.8 to 98 g/l as converted into sulfuric acid. An organic acid content of under 4.8 g/l as converted into sulfuric acid leads to a lower solubility of divalent tin ions into the acid tin-electroplating solution, and hence easier production of sludge. On the other hand, an organic acid content of over 98 g/f as converted into sulfuric acid results in a lower pH value of the acidic tin-electroplating solution, a more vigorous producing reaction of hydrogen gas on the metal strip, and a lower electrolytic efficiency, thus making it impossible to obtain a dense tin-electroplating layer.

Any acidic tin-electroplating solution containing stannous ions as the main component in addition to the organic acid may be employed. Various organic compounds and metal ions other than tin ions may as required be added to the acidic tin-electroplating solution containing the tin ions and the organic acid with a view to improving electroplatability.

A plurality of kinds of organic acid may be added in mixture to the acidic tin-electroplating solution containing tin ions. The organic acid may be added in mixture with such inorganic acids as sulfuric acid and borofluoric acid.

As an organic acid, it is desirable to use any of such organic sulfonic acids as benzene sulfonic acid, methane sulfonic acid, toluene sulfonic acid and phenol sulfonic acid.

As described above, by causing a DC electric current to flow between the metal strip and the anode arranged adjacent to the metal strip while passing the metal strip at a travelling speed of at least 1 m/second through the acidic tin-electroplating solution containing the tin ions and the organic acid within a range of from 4.8 to 98 g/l as converted into sulfuric acid, and applying an ultrasonic vibration, emitted from at least one ultrasonic vibrator and having an intensity within a range of from 0.01 to 1,000 W/100 $cm^2$ and a frequency within a range of from 25 to 55 kHz, to the acidic tin-electroplating solution between the metal strip and the anode, it is possible to accelerate the dissociation of divalent tin ions from the complex, to remove the diffusion layer of tin ions existing in the acidic tin-electroplating solution adjacent to the surface of the metal strip, and to considerably increase the critical electric current density, thereby forming a tin-electroplating layer excellent in quality on the surface of the metal strip at a high electric current density. Furthermore, it is possible to decrease the number of tin-electroplating tanks and to reduce costs for manufacture and equipment.

Now, the reason why a phenyl hydroxide compound is additionally added to the acidic tin-electroplating solution containing the tin ions and the organic acid, is described below.

By causing a DC electric current to flow between the metal strip and the anode arranged adjacent to the metal strip while passing the metal strip at a travelling speed of at least 1 m/second through the acidic tin-electroplating solution containing the tin ions and the organic acid within a range of from 4.8 to 98 g/l as converted into sulfuric acid, and applying an ultrasonic vibration, emitted from at least one ultrasonic vibrator and having an intensity within a range of from 0.01 to 1,000 W/100 $cm^2$ and a frequency within a range of from 25 to 55 kHz, to the acidic tin-electroplating solution between the metal strip and the anode, it is possible, as described above, to accelerate the dissociation of divalent tin ions from the complex, to remove the diffusion layer of tin ions existing in the acidic tin-electroplating solution adjacent to the surface of the metal strip, and to considerably increase the critical electric current density, but at the same time, sludge is produced in a larger quantity under the effect of the oxidation of divalent tin ions.

The relationship between the ultrasonic frequency and the amount of produced sludge was investigated by applying an ultrasonic vibration having an intensity within a range of from 0.01 to 1,000 W/100 $cm^2$ to an acidic tin-electroplating solution containing tin ions and an organic acid while varying the frequency of the ultrasonic vibration within a range of from over 1 to 1,500 kHz. It was found as a result that an ultrasonic vibration having a frequency outside the scope of the present invention of from 25 to 55 kHz, had an effect of inhibiting the production of sludge caused by the oxidation of divalent tin ions. It was also found that an ultrasonic vibration having a frequency within the scope of the present invention of from 25 to 55 kHz, had almost no effect of inhibiting the production of sludge caused by the oxidation of divalent tin ions.

For the purpose of inhibiting the production of sludge caused by the oxidation of divalent tin ions, studies were carried out by adding various oxidation inhibiting agents to the acidic tin-electroplating solution containing the tin ions and the organic acid. As a result, the use of an acidic tin-electroplating solution prepared by adding a phenyl hydroxide compound ($C_6H_4(OH)X$, where X is a substitution radical of OH or $NH_2$) to the acidic tin-electroplating solution containing the tin ions and the organic acid, was found to hardly cause the production of sludge even under the application of an ultrasonic vibration having a frequency within the range of from 25 to 55 kHz.

The content of phenyl hydroxide compound should be limited within a range of from 0.1 to 5 g/l . With a content of phenyl hydroxide compound of under 0.1 g/l or over 5 g/f , a desired effect of inhibiting the production of sludge caused by the oxidation of divalent tin ions is unavailable.

A plurality of kinds of phenyl hydroxide compound may be added in mixture to the acidic tin-electroplating solution containing the tin ions and the organic acid.

As a phenyl hydroxide compound, it is desirable to use any of pyrocatechol, resorcinol, hydrochinone, phloroglucinol, pyrogallol and 3-aminophenol.

As described above, by causing a DC electric current to flow between the metal strip and the anode arranged adjacent to the metal strip while passing the metal strip at a travelling speed of at least 1 m/second through the acidic tin-electroplating solution containing the tin ions, the organic acid within a range of from 4.8 to 98 g/l as converted into sulfuric acid and the phenyl hydroxide compound within a range of from 0.1 to 5 g/f , and applying the ultrasonic vibration, emitted from at least one ultrasonic vibrator and having an intensity within a range of from 0.01 to 1,000 W/100 $cm^2$ and a frequency within a range of from 25 to 55 kHz, to the acidic tin-electroplating solution between the metal strip and the anode, it is possible to accelerate the dissociation of divalent tin ions from the complex, to remove the diffusion layer of tin ions existing in the acidic tin-electroplating solution adjacent to the surface of the metal strip, to considerably increase the critical electric current density, and in addition, to inhibit the production of sludge caused by the oxidation of divalent tin ions, thereby forming a tin-electroplating layer excellent in quality at a high electric current density. Furthermore, it is possible to decrease the number of tin-electroplating tanks and to reduce costs for manufacture and equipment.

Now, the reason why an acidic tin-electroplating solution is ejected as required into the acidic tin-electroplating solution between the metal strip and the anode to cause the tin-electroplating solution between the metal strip and the anode to flow.

By ejecting an acidic tin-electroplating solution into the acidic tin-electroplating solution between the metal strip and the anode to cause the acidic tin-electroplating solution between the metal strip and the anode to flow, the acidic tin-electroplating solution between the metal strip and the anode is stirred, thus permitting the acceleration of the removing effect of the diffusion layer of tin ions by means of the ultrasonic vibration. By causing the acidic tin-electroplating solution between the metal strip and the anode to flow, furthermore, it is possible to remove bubbles finely pulverized by the action of the ultrasonic vibration, present in the acidic tin-electroplating solution between the metal strip and the anode. In the method of the present invention, therefore, an acidic tin-electroplating solution is optionally ejected into the acidic tin-electroplating solution between the metal strip and the anode to cause the acidic tin-electroplating solution between the metal strip and the anode to flow.

A plating treatment of at least one of the following metals other than tin on the surface of the metal strip and/or a surface treatment of the metal strip, may be applied to the metal strip before or after the application of the method of the present invention:

(1) Plating of one of, or plating of an alloy of two or more of, such metals as nickel, iron, zinc, chromium, cobalt and phosphorus;

(2) An electrolytic chromating treatment or other chemical treatment, or a heat treatment such as a melting treatment, i.e., a reflowing treatment.

FIG. 1 is a partially cutaway schematic side view illustrating an embodiment of the method of the present invention using the conventional radial-type tin-electroplating apparatus. A main roll 2 for stretching a metal strip 1 is provided in a tin-electroplating tank 11 for receiving an acidic tin-electroplating solution. The metal strip 1 continuously travels through the acidic electroplating solution received in the tin-electroplating tank 11 in the arrow direction in FIG. 1. A lower portion of the main roll 2 is immersed into the tin-electroplating solution received in the tin-electroplating tank 11. Two guide rolls 9, 9 are provided, one above the inlet side of the main roll 2 and the other, above the exit side thereof. The two guide rolls 9, 9 guide the metal strip 1 to the main roll 2 and guide same outside from the tin-electroplating tank 11. An anode 5 is arranged below the main roll 2 at a prescribed distance from the outer peripheral surface of the main roll 2. The anode 5 has a concavely curved surface concentric with the main roll 2, directed toward the main roll 2. The negative pole of a DC power source for tin-electroplating not shown is connected to the main roll 2, or at least one of the two guide rolls 9, 9. The positive pole of the DC power source for tin-electroplating is connected to the anode 5. In FIG. 1, 6 is an electricity supply section of the anode 5. A plurality of ultrasonic vibrators 4 are secured at prescribed intervals to the outer peripheral surface of the anode 5 relative to the metal strip 1. Each of the plurality of ultrasonic vibrators 4 is connected through a lead wire not shown, to an ultrasonic wave generator not shown provided outside the tin-electroplating tank 11. Application of the ultrasonic vibration emitted from the ultrasonic vibrators 4 to the anode 5 causes the vibration of the anode 5, and hence the vibration of the acidic tin-electroplating solution between the metal strip 1 and the anode 5. An ejecting means 7 of the tin-electroplating solution is provided at a position adjacent to one end of the anode 5 on the exit side of the main roll 2. The acidic tin-electroplating solution between the metal strip 1 and the anode 5 is caused to flow by ejecting an acidic tin-electroplating solution from the ejecting means 7 into the acidic tin-electroplating solution between the metal strip 1 and the anode 5. In FIG. 1, 3 is a bearing of the main roll 2, 8 is a support of the bearing 3, 10 is a strut, 13 is a beam, and 12 is a cover which covers from above the tin-electroplating apparatus.

When causing a DC electric current to flow between the metal strip 1 and the anode 5 while continuously passing the metal strip 1 through the acidic tin-electroplating solution to form a tin-electroplating layer of the surface of the metal strip 1, the diffusion layer of tin ions existing in the acidic tin-electroplating solution adjacent to the surface of the metal strip 1 can be removed by applying the ultrasonic vibration emitted from the ultrasonic vibrators 4 to the anode 5 to vibrate the acidic tin-electroplating solution between the metal strip 1 and the anode 5.

By ejecting an acidic tin-electroplating solution from the ejecting means 7 into the acidic tin-electroplating solution between the metal strip 1 and the anode 5 to cause the acidic tin-electroplating solution between the metal strip 1 and the anode 5 to flow, the acidic tin-electroplating solution between the metal strip 1 and the anode 5 is stirred, thus permitting the acceleration of the removing effect of the diffusion layer of tin ions by means of the ultrasonic vibration. Furthermore, by causing the acidic tin-electroplating solution between the metal strip 1 and the anode 5 to flow, it is possible to remove bubbles finely pulverized by the action of the ultrasonic vibration, present in the acidic tin-electroplating solution between the metal strip 1 and the anode 5.

Now, the method of the present invention is described further in detail by means of examples while comparing with comparative examples.

EXAMPLE 1

There were prepared two kinds of acidic tin-electroplating solution A and B within the scope of the present invention, containing tin ions and an organic acid and having the following respective chemical compositions:

(1) Acidic tin-electroplating solution A:

$Sn^{2+}$: 20 g/l , $Sn^{4+}$: 1 g/l,

Phenol sulfonic acid 15 g/l as converted into sulfuric acid, and

Ethoxynaphthol sulfonic acid : under 5 g/l.

(2) Acidic tin-electroplating solution B:

$Sn^{2+}$: 20 g/l , $Sn^{4+}$: 1 g/l ,

Methane sulfonic acid : 20 g/l as converted into sulfuric acid, and

Ethoxynaphthol sulfonic acid : under 5 g/l .

A cold-rolled steel strip 1 having a thickness of 0.2 mm, which had been annealed and then temper-rolled, was degreased and then pickled. Then, using the conventional radial-type tin-electroplating apparatus as shown in FIG. 1, and using each of the acidic tin-electroplating solutions A and B, an ultrasonic vibration, having an intensity within a range of from 5 to 30 W/100 $cm^2$ and emitted from the ultrasonic vibrators 4, was applied to the anode 5 while varying the frequency of the ultrasonic vibration within a range of from 1 to 1,500 kHz to vibrate the acidic tin-electroplating solution between the steel strip 1 and the anode 1. A tin-electroplating layer was continuously formed on the surface of the travelling steel strip 1 at a critical electric current density while continuing the above-mentioned ultrasonic vibration of the acidic tin-electroplating solution between the steel strip 1 and the anode 5. The relationship between the ultrasonic frequency and the critical electric current density was investigated.

The tin-electroplating conditions were as follows:

(1) Critical electric current density:

The critical electric current density was determined using as a standard the upper limit of the electric current density at which a satisfactory external appearance of the tin-electroplating layer is available.

(2) Temperature of acidic tin-electroplating solution : 40° C., (3) Material of tin ions supplied to the acidic tin-electroplating solution : granular stannous ions, and (4) Travelling speed of steel strip : 100 m/minute.

An insoluble anode having a film comprising at least an iridium oxide formed on the surface of a titanium substrate, was employed as the anode.

Figure 2:
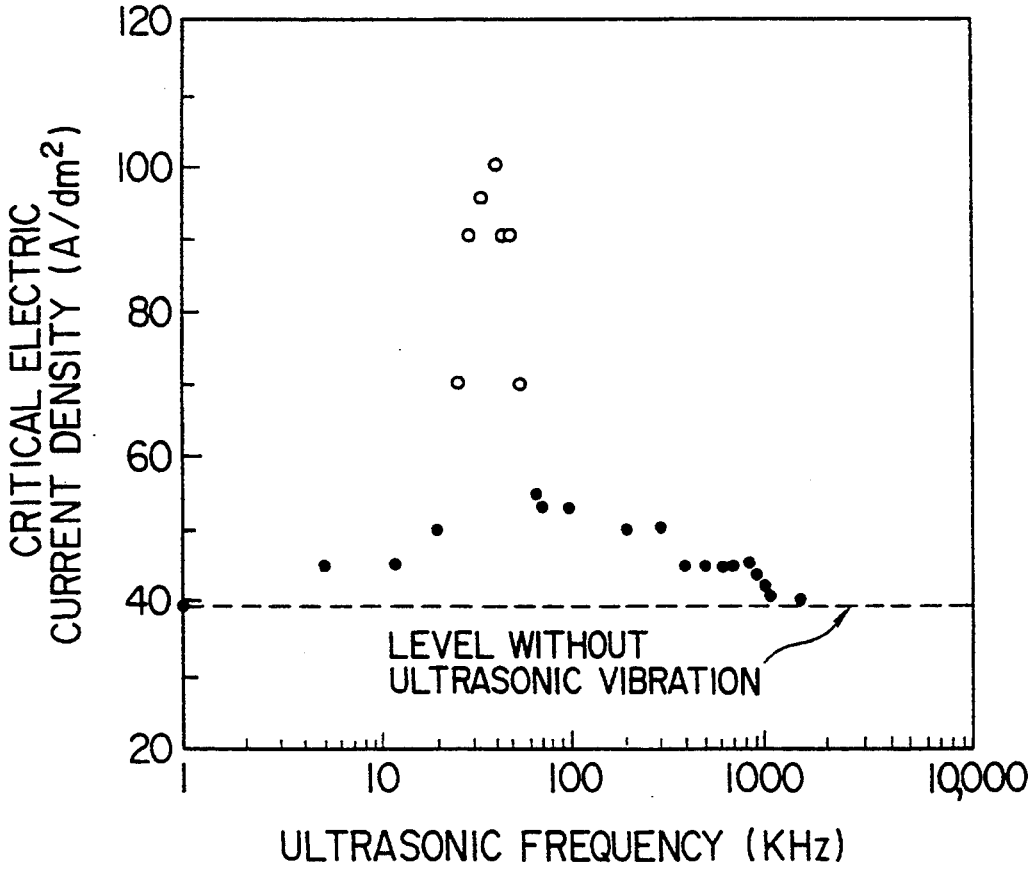
FIG. 2 is a graph illustrating the relationship between the ultrasonic frequency and the critical electric current density when using the acidic tin-electroplating solution A containing tin ions and an organic acid, in the Example 1 of the method of the present invention.

FIG. 2 is a graph illustrating the relationship between the ultrasonic frequency and the critical electric current density when using the acidic tin-electroplating solution A. In FIG. 2, the mark"○" represents a case within the scope of the present invention, where an ultrasonic vibration having a frequency of from 25 to 55 kHz falling within the scope of the present invention, was applied to the acidic tin-electroplating solution A; and the mark "●" represents a comparative case outside the scope of the present invention, where an ultrasonic vibration having a frequency of under 25 kHz or over 55 kHz falling outside the scope of the present invention, was applied to the acidic tin-electroplating solution A. The horizontal broken line in FIG. 2 indicates the level of the critical electric current density without the application of an ultrasonic vibration to the acidic tin-electroplating solution A.

As shown in FIG. 2, in the case within the scope of the present invention, where an ultrasonic vibration having a frequency within a range of from 25 to 55 kHz was applied to the acidic tin-electroplating solution A, the critical electric current density was considerably increased as compared with that in the comparative case outside the scope of the present invention, where an ultrasonic vibration having a frequency of under 25 kHz or over 55 kHz was applied to the acidic tin-electroplating solution A.

Figure 3:
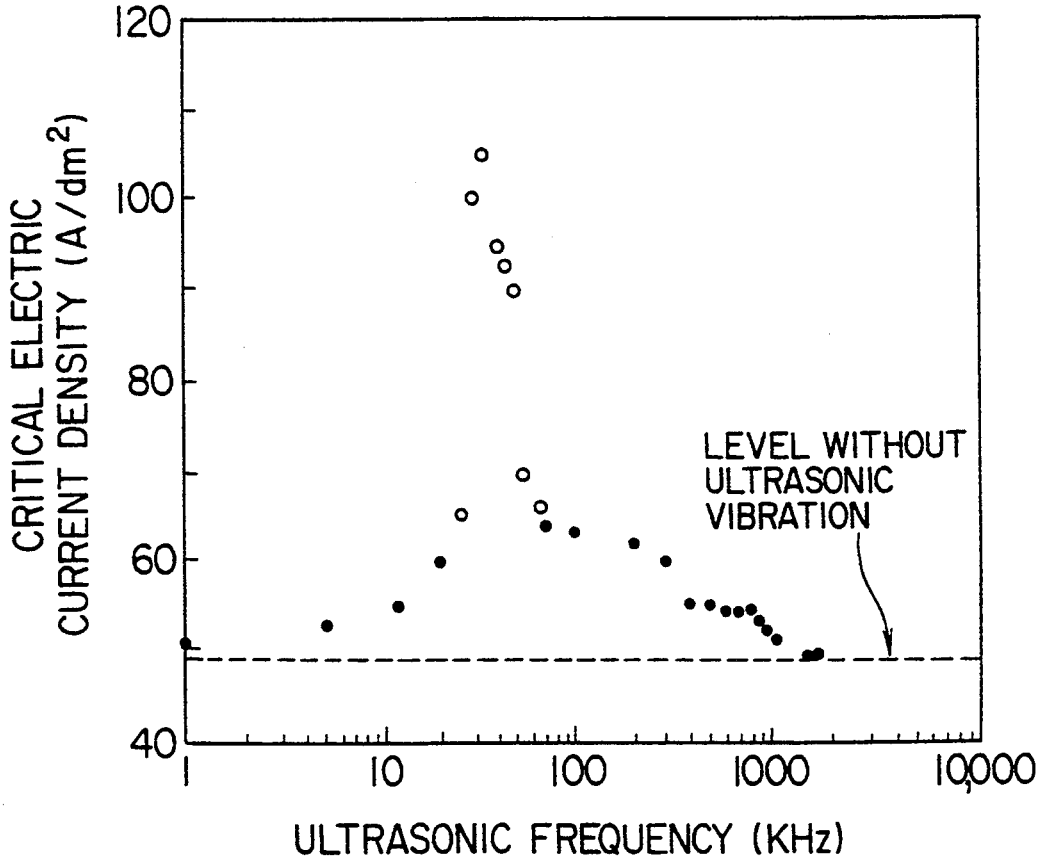
FIG. 3 is a graph illustrating the relationship between the ultrasonic frequency and the critical electric current density when using the acidic tin-electroplating solution B containing tin ions and an organic acid, in the Example 1 of the method of the present invention.

FIG. 3 is a graph illustrating the relationship between the ultrasonic frequency and the critical electric current density when using the acidic tin-electroplating solution B. In FIG. 3, the mark"○" represents a case within the scope of the present invention, where an ultrasonic vibration having a frequency of from 25 to 55 kHz falling within the scope of the present invention, was applied to the acidic tin-electroplating solution B; and the mark "●" represents a comparative case outside the scope of the present invention, where an ultrasonic vibration having a frequency of under 25 kHz or over 55 kHz falling outside the scope of the present invention, was applied to the acidic tin-electroplating solution B. The horizontal broken line in FIG. 3 indicates the level of the critical electric current density without the application of an ultrasonic vibration to the acidic tin-electroplating solution B.

As shown in FIG. 3, in the case within the scope of the present invention, where an ultrasonic vibration having a frequency within a range of from 25 to 55 kHz was applied to the acidic tin-electroplating solution B, the critical electric current density was considerably increased as compared with that in the comparative case outside the scope of the present invention, where an ultrasonic vibration having a frequency of under 25 kHz or over 55 kHz was applied to the acidic tin-electroplating solution B.

EXAMPLE 2

There were prepared two kinds of acidic tin-electroplating solution C and E within the scope of the present invention containing tin ions and an organic acid and having the following respective chemical compositions, and another two kinds of acidic tin-electroplating solution D and F within the scope of the present invention containing a phenyl hydroxide compound in addition to tin ions and an organic acid and having the following respective chemical compositions:

(1) Acidic tin-electroplating solution C:

$Sn^{2+}$: 60 g/l, $Sn^{4+}$: 1 g/l,

Phenol sulfonic acid : 30 g/l as converted into sulfuric acid, and

Ethoxynaphthol sulfonic acid : 5 g/l;

(2) Acidic tin-electroplating solution D additionally containing a phenyl hydroxide compound:

$Sn^{2+}$: 60 g/l, $Sn^{4+}$: 1 g/l,

Phenol sulfonic acid : 30 g/l as converted into sulfuric acid,

Ethoxynaphthol sulfonic acid : 5 g/l, and

Hydrochinone : 3 g/l;

(3) Acidic tin-electroplating solution E:

$Sn^{2+}$: 60 g/l , $Sn^{4+}$: 1 g/l ,

Methane sulfonic acid : 40 g/l as converted into sulfuric acid, and

Ethoxynaphthol sulfonic acid : under 5 g/l; and (4) Acidic tin-electroplating solution F additionally containing a phenyl hydroxide compound:

$Sn^{2+}$: 60 g/l , $Sn^{4+}$: 1 g/l ,

Methane sulfonic acid : 40 g/f as converted into sulfuric acid,

Ethoxynaphthol sulfonic acid : under 5 g/f , and

Resorcinol : 3 g/l .

A cold-rolled steel strip 1 having a thickness of 0.2 mm, which had been annealed and then temper-rolled, was degreased and then pickled. Then, using the conventional radial-type tin-electroplating apparatus as shown in FIG. 1, and using each of the acidic tin-electroplating solutions C and E, and the acidic tin-electroplating solutions D and F additionally containing a phenyl hydroxide compound, an ultrasonic vibration, having an intensity within a range of from 5 to 30 W/100 $cm^2$ and emitted from the ultrasonic vibrators 4, was applied to the anode 5 while varying the frequency of the ultrasonic vibration within a range of from 1 to 1,500 kHz to vibrate the acidic tin-electroplating solution between the steel strip 1 and the anode 5. A tin-electroplating layer was continuously formed on the surface of the travelling steel strip 1 while continuing the above-mentioned ultrasonic vibration of the acidic tin-electroplating solution between the steel strip 1 and the anode 5. The effects of the kind of acidic tin-electroplating solution and the ultrasonic frequency on inhibition of the oxidation of divalent tin ions, i.e., inhibition of the production of sludge.

The tin-electroplating conditions were as follows:

(1) Electric current density : from 30 to 100 A/$dm^2$, (2) Temperature of acidic tin-electroplating solution : 40° C., (3) Material of tin ions supplied into acidic tin-electroplating solution : granular stannous ions, and (4) Travelling speed of steel strip : 150 m/minute.

An insoluble anode having a film comprising at least an iridium oxide formed on the surface of a titanium substrate, was employed as the anode.

Inhibition of the production of sludge was evaluated in the following manner:

The amount of divalent tin ions in the acidic tin-electroplating solution was measured at the time when the tin-electroplating was started. Then, the amount of divalent tin ions oxidized into tetravalent tin ions in the acidic tin-electroplating solution was measured upon the lapse of 20 hours from the start of the tin-electroplating. Then, a calculation was performed to determine the ratio of the amount of divalent tin ions oxidized into tetravalent tin ions upon the lapse of 20 hours from the start of the tin-electroplating, to the amount of divalent tin ions at the start of the tin-electroplating (hereinafter referred to as the "amount of oxidized divalent tin ions").

Figure 4:
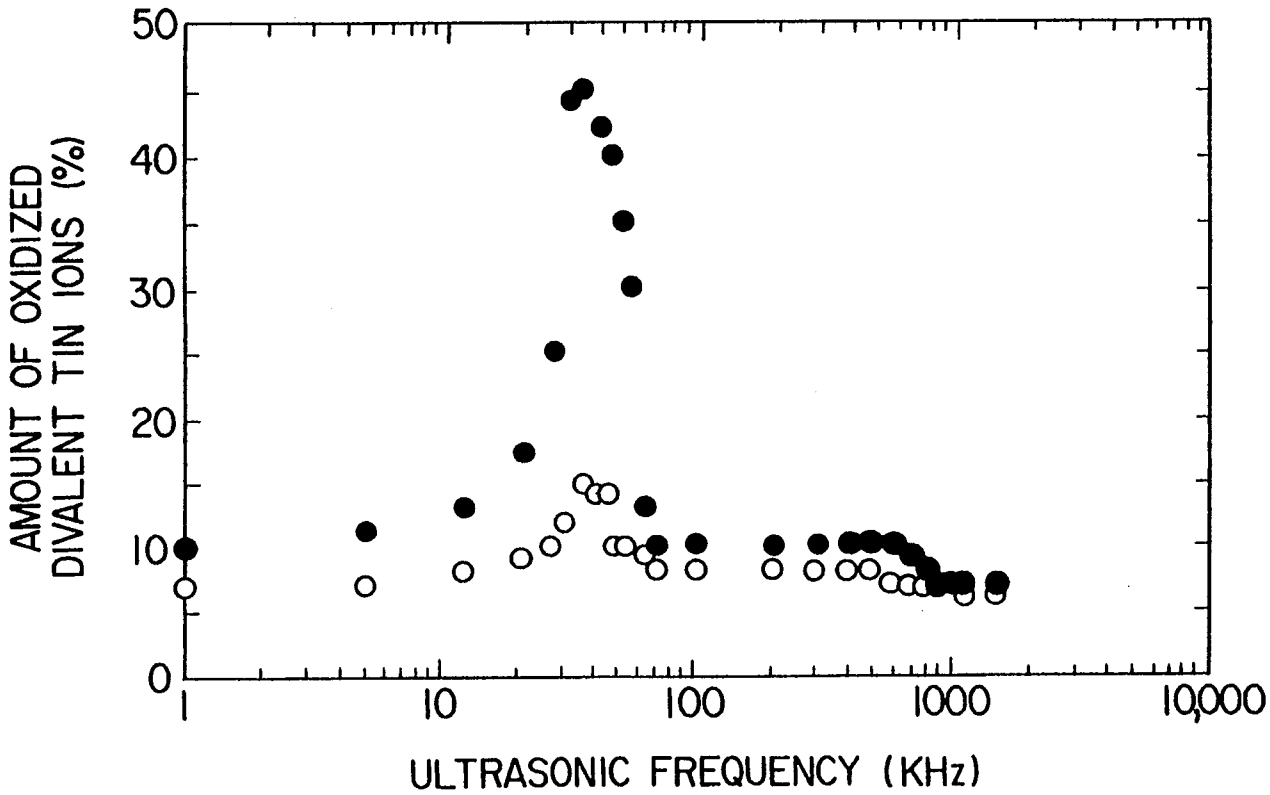
FIG. 4 is a graph illustrating the relationship between the ultrasonic frequency and the amount of oxidized divalent tin ions when using the acidic tin-electroplating solution C containing tin ions and an organic acid, and when using the acidic tin-electroplating solution D containing a phenyl hydroxide compound in addition to tin ions and an organic acid, in the Example 2 of the method of the present invention.

FIG. 4 is a graph illustrating the relationship between the ultrasonic frequency and the amount of oxidized divalent tin ions when using the acidic tin-electroplating solution C containing tin ions and an organic acid, and when using the acidic tin-electroplating solution D containing a phenyl hydroxide compound in addition to tin ions and an organic acid. In FIG. 4, the mark "●" represents a case where the acidic tin-electroplating solution C was used, and the mark "○" represents a case where the acidic tin-electroplating solution D was used.

As shown in FIG. 4, with an ultrasonic frequency of from 25 to 55 kHz within the scope of the present invention, the amount of oxidized divalent tin ions in the case of using the acidic tin-electroplating solution D containing hydrochinone as a phenyl hydroxide compound in addition to tin ions and phenol sulfonic acid as an organic acid, was smaller by about 70% than in the case of using the acidic tin-electroplating solution C containing tin ions and phenol sulfonic acid as an organic acid.

Figure 5:
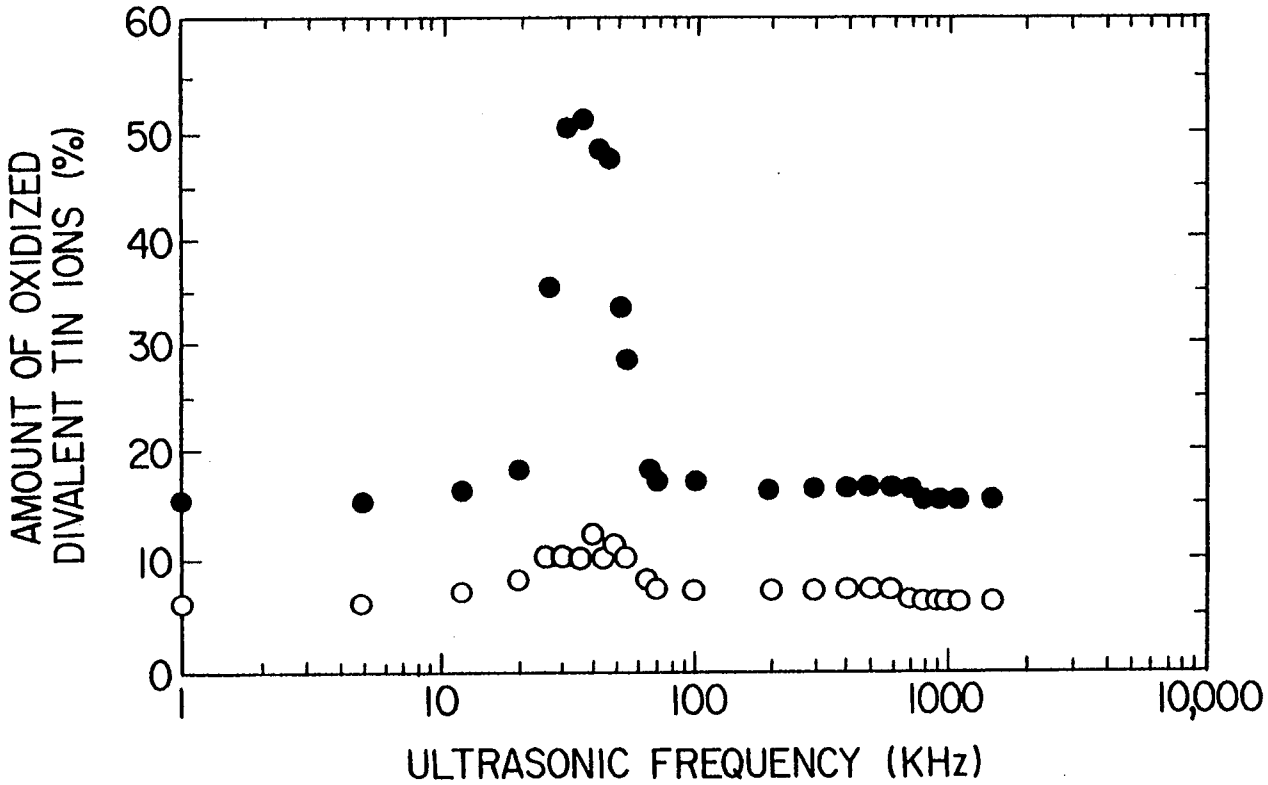
FIG. 5 is a graph illustrating the relationship between the ultrasonic frequency and the amount of oxidized divalent tin ions when using the acidic tin-electroplating solution E containing tin ions and an organic acid, and when using the acidic tin-electroplating solution F containing a phenyl hydroxide compound in addition to tin ions and an organic adicd, in the Example 2 of the method of the present invention.

FIG. 5 is a graph illustrating the relationship between the ultrasonic frequency and the amount of oxidized divalent tin ions when using the acidic tin-electroplating solution E containing tin ions and an organic acid, and when using the acidic tin-electroplating solution F containing a phenyl hydroxide compound in addition to tin ions and an organic acid. In FIG. 5, the mark "●" represents a case where the acidic tin-electroplating solution E was used, and the mark "○" represents a case where the acidic tin-electroplating solution F was used.

As shown in FIG. 5, with an ultrasonic frequency of from 25 to 55 kHz within the scope of the present invention, the amount of oxidized divalent tin ions in the case of using the acidic tin-electroplating solution F containing resorcinol as a phenyl hydroxide compound in addition to tin ions and methane sulfonic acid as an organic acid, was smaller by about 80% than in the case of using the acidic tin-electroplating solution E containing tin ions and methane sulfonic acid as an organic acid.

Figure 6:
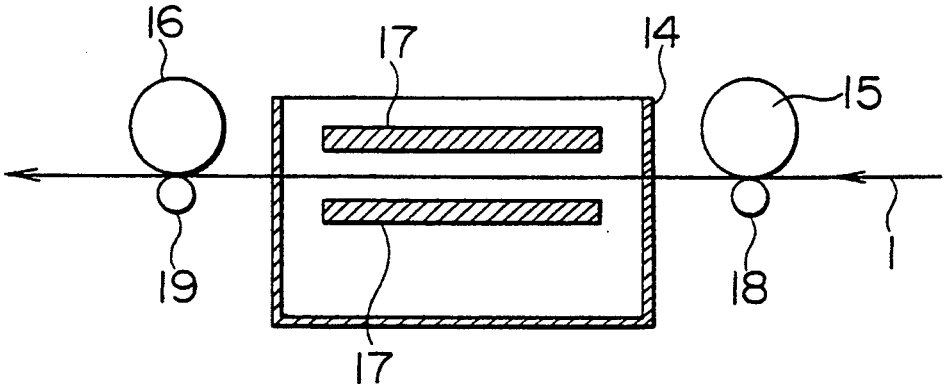
FIG. 6 is a schematic vertical sectional view illustrating an example of the conventional horizontal-type tin-electroplating apparatus.

Although both the above-mentioned Examples 1 and 2 have covered cases where the conventional radial-type tin-electroplating apparatus was used, the method of the present invention may also be applied with the use of any of the following conventional tin-electroplating apparatus as well:

(1) Conventional horizontal-type tin-electroplating apparatus as illustrated in the schematic vertical sectional view of FIG. 6, which comprises:

a horizontal-type tin-electroplating tank 14 for receiving a tin-electroplating solution; a first conductor roll 15, arranged on a metal strip inlet side outside said tin-electroplating tank 14, for introducing a metal strip 1 substantially horizontally into said tin-electroplating tank 14 and supplying electricity to said metal strip 1; a first backup roll 18, arranged on the metal strip inlet side outside said tin-electroplating tank 14, for squeezing said metal strip 1 in cooperation with said first conductor roll 15 and introducing said metal strip 1 into said tin-electroplating tank 14; a second conductor roll 16, arranged on a metal strip exit side outside said tin-electroplating tank 14, for introducing said metal strip 1 substantially horizontally outside said tin-electroplating tank 14 and supplying electricity to said metal strip 1; a second backup rolls 19, arranged on the metal strip exit side outside said tin-electroplating tank 14, for squeezing said metal strip 1 in cooperation with said second conductor roll 16 and introducing said metal strip 1 outside said tin-electroplating tank 14; and a pair of anode plates 17, 17 for tin-electroplating the both surfaces of said metal strip 1, which are arranged in said tin-electroplating tank 14 substantially in parallel with said metal strip 1 and with said metal strip 1 therebetween.

The metal strip 1 travels substantially horizontally through the tin-electroplating solution received in the tin-electroplating tank 14 while being introduced by the first conductor roll 15, the first backup roll 18, the second conductor roll 16 and the second backup roll 19, and the both surfaces of the metal strip 1 are tin-electroplated while passing between the pair of anodes 17, 17.

Figure 7:
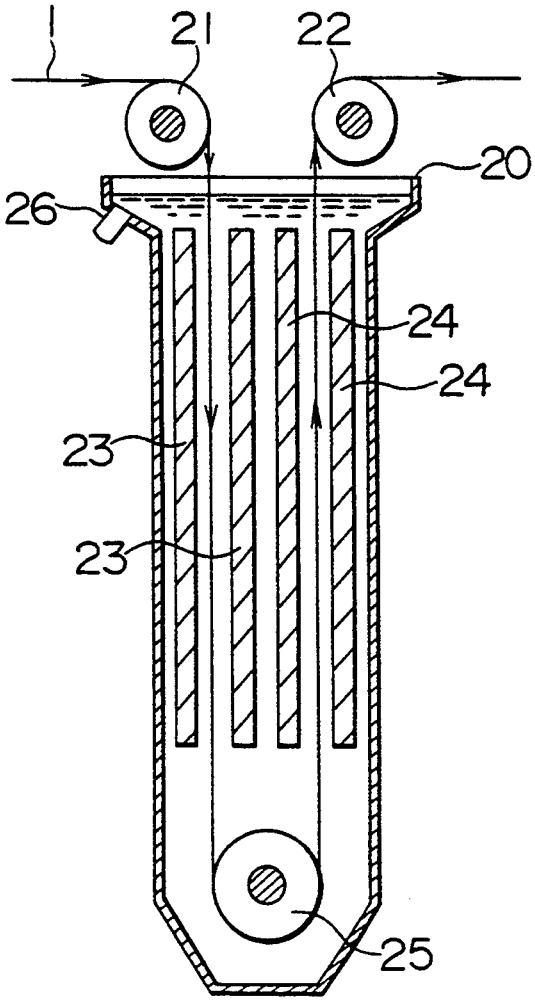
FIG. 7 is a schematic vertical sectional view illustrating an example of the conventional vertical-type tin-electroplating apparatus.

(2) Conventional vertical-type tin-electroplating apparatus as illustrated in the schematic vertical sectional view of FIG. 7, which comprises:

a vertical-type tin-electroplating tank 20 for receiving a tin-electroplating solution; a first conductor roll 21, arranged above a metal strip inlet side of said tin-electroplating tank 20, for introducing a metal strip 1 substantially vertically downward into said vertical-type tin-electroplating tank 20 and supplying electricity to said metal strip 1; a sink roll 25, arranged in said tin-electroplating tank 20, for reversing upward the travelling direction of said metal strip 1 introduced into said tin-electroplating tank 20; a second conductor roll 22, arranged above a metal strip exit side of said tin-electroplating tank 20, for introducing said metal strip 1 substantially vertically upward outside said tin-electroplating tank 20 and supplying electricity to said metal strip 1; a pair of first anode plates 23, 23 for tin-electroplating the both surfaces of said metal strip 1, which are arranged in said tin-electroplating tank 20 between said first conductor roll 21 and said sink roll 25 substantially in parallel with said metal strip 1 and with said metal strip 1 therebetween; a pair of second anode plates 24, 24 for tin-electroplating the both surfaces of said metal strip 1, which are arranged in said tin-electroplating tank 20 between said sink roll 25 and said second conductor roll 22 substantially in parallel with said metal strip 1 and with said metal strip 1 therebetween; and a tin-electroplating solution discharge pipe 26, provided on the top portion of said tin-electroplating tank 20, for causing the tin-electroplating solution in said tin-electroplating tank 20 to overflow.

The metal strip 1 travels downward and then upward through the tin-electroplating solution received in the tin-electroplating tank 20 while being introduced by the first conductor roll 21, the sink roll 25 and the second conductor roll 22, and the both surfaces of-the metal strip 1 are tin-electroplated while passing between the pair of first anodes 23, 23 and between the pair of second anodes 24, 24.

Figure 8:
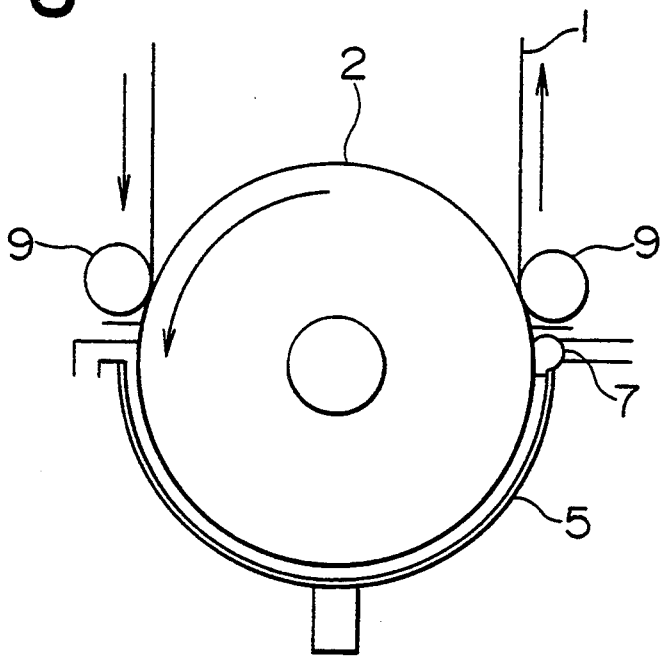
FIG. 8 is a schematic descriptive view illustrating another example of the conventional radial-type tin-electroplating apparatus.

(3) Another example of the conventional radial-type tin-electroplating apparatus as illustrated in the schematic descriptive view of FIG. 8, which comprises:

A main roll 2 for stretching a metal strip 1; an anode 5, arranged below said main roll 2 at a prescribed distance from the outer peripheral surface of said main roll 2, said anode 5 having a concavely curved surface concentric with said main roll 2 directed toward said main roll 2 and serving as a tin-electroplating tank for receiving a tin-electroplating solution; two guide rolls 9, 9 for guiding said metal strip 1 to the main roll 2 and guiding same outside from said main roll 2 as the tin-electroplating tank, said two guide rolls 9, 9 being arranged one above the inlet side of said main roll 2 and the other, above the exit side thereof, said main roll 2 and/or at least one of said two guide rolls 9, 9 serving as a conductor roll; and an ejecting means 7, provided at a position adjacent to one end of said anode 5 on the exit side of said main roll 2, for supplying a tin-electroplating solution into the space between said main roll 2 and said anode 5.

The metal strip 1 travels through the tin-electroplating solution received in the space between the main roll 2 and the anode 5 while being guided by the main roll 2 and the two guide rolls 9, 9, and the surface of the metal strip 1 facing the anode 5 is tin-electroplated while passing between the main roll 2 and the anode 5.

According to the method of the present invention, as described above in detail, the following industrially useful effects are provided:

(1) When causing a DC electric current to flow between a metal strip and an anode arranged adjacent to the metal strip while passing the metal strip through an acidic tin-electroplating solution containing tin ions and an organic acid, to form a tin-electroplating layer on at east one surface of the metal strip, by applying an ultrasonic vibration to the acidic tin-electroplating solution between the metal strip and the anode, it is possible to accelerate the dissociation of divalent tin ions from the complex formed by the combination with the organic acid, to remove a diffusion layer of tin ions existing in the acidic tin-electroplating solution adjacent to the surface of the steel strip so as to increase the critical electric current density, to reduce the number of tin-electroplating tanks, and thus to reduce costs for manufacture and equipment.

(2) By additionally adding a phenyl hydroxide compound to the acidic tin-electroplating solution containing tin ions and the organic acid, it is possible to inhibit the production of sludge caused by the oxidation of divalent tin ions in the acidic tin-electroplating solution.

What is claimed is:

1. In a method for continuously tin-electroplating a metal strip, which comprises the steps of:

causing a DC electric current to flow between a metal strip and an anode arranged adjacent to said metal strip, while passing said metal strip at a travelling speed of at least 1 m/minute through an acidic tin-electroplating solution to form a tin-electroplating layer on at least one surface of said metal strip; and applying an ultrasonic vibration, emitted from at least one ultrasonic vibrator to said acidic tin-electroplating solution between said metal strip and said anode;

the improvement comprising:

said acidic tin-electroplating solution containing tin ions and an organic acid within a range of from 4.8 to 98 g/l as converted into sulfuric acid, and a phenyl hydroxide compound within a range of from 0.1 to 5 g/l;

passing said metal strip at a travelling speed of at least 100 m/minute through said acidic tin-electroplating solution; and said ultrasonic vibration having an intensity within a range of from 0.01 to 1,000 W/100 $cm^2$ and a frequency within a range of from 25 to 55 kHz;

thereby removing a diffusion layer of tin ions existing in said acidic tin-electroplating solution adjacent to the surface of said metal strip, and increasing a critical electric current density to a range of from 65 to 110 $A/dm^2$.

2. A method as claimed in claim 1, wherein:

said organic acid comprises at least one of benzene sulfonic acid, methane sulfonic acid, toluene sulfonic acid and phenol sulfonic acid.

3. A method as claimed in claim 1, wherein:

said phenyl hydroxide compound comprises at least one of pyrocatechol, resorcinol, hydrochinone, phloroglucinol, pyrogallol and 3-aminophenol.

4. A method as claimed in any one of claims 1, 2 or 3 wherein:

an acidic tin-electroplating solution is ejected into said acidic tin-electroplating solution between said metal strip and said anode to cause said acidic tin-electroplating solution between said metal strip and said anode to flow.

* * * * *